United States Patent [19]

Rhodehouse et al.

[11] Patent Number: 5,022,378

[45] Date of Patent: Jun. 11, 1991

[54] ARROW REST/OVERDRAWN APPARATUS FOR AN ARCHERY BOW

[75] Inventors: Nolin C. Rhodehouse, Idaho Falls, Id.; Terry G. Martin; George T. Newbold, both of Walla Walla, Wash.

[73] Assignee: Martin Archery, Inc., Walla Walla, Wash.

[21] Appl. No.: 459,992

[22] Filed: Jan. 2, 1990

Related U.S. Application Data

[63] Continuation-in-part of Ser. No. 349,517, May 9, 1989, abandoned.

[51] Int. Cl.[5] ..... F41B 5/00

[52] U.S. Cl. ..... 124/44.5; 124/24.1; 124/86

[58] Field of Search ..... 124/23.1, 24.1, 25.6, 124/44.5, 86, 88

[56] References Cited

U.S. PATENT DOCUMENTS

| | | |
|---|---|---|
| 2,664,078 | 12/1953 | Irwin . |
| 2,816,537 | 12/1957 | Irwin . |
| 2,975,780 | 3/1961 | Fisher . |
| 3,623,468 | 11/1971 | Crest . |
| 3,923,035 | 12/1975 | Trotter . |
| 4,027,645 | 6/1977 | Damron . |
| 4,146,009 | 3/1979 | Adams . |
| 4,287,868 | 9/1981 | Schiff . |
| 4,290,407 | 9/1981 | Damron . |
| 4,378,780 | 4/1983 | Izuta . |
| 4,579,101 | 4/1986 | Batemann, III . |
| 4,632,087 | 12/1986 | Cline . |
| 4,732,133 | 3/1988 | Chattin . |
| 4,829,974 | 5/1989 | Anderson . |
| 4,838,237 | 6/1989 | Cliburn . |

*Primary Examiner*—Peter M. Cuomo
*Assistant Examiner*—John A. Ricci
*Attorney, Agent, or Firm*—Wells, St. John & Roberts

[57] ABSTRACT

An overdraw apparatus supports an arrow for shooting at a support location between the drawstring full-draw rearward position and the drawstring full-forward travel position upon its release. A construction is provided whereby the drawstring can pass through and beyond the support location, and thereby enable much shorter arrows to be shot from a conventional bow than would otherwise be possible. In one embodiment, the actual arrow support includes two members which are separated by a space which allows the drawstring to pass therebetween. In another embodiment, the arrow support includes a pivotally mounted arm which gets struck by the bowstring and pivots forwardly to accommodate the movement of the drawstring forwardly beyond the support location.

32 Claims, 11 Drawing Sheets

ARROW REST/OVERDRAWN APPARATUS FOR AN ARCHERY BOW

This application is a continuation-in-part of Ser. No. 07/349,517, filed May 9, 1989, entitled "Overdraw Apparatus for Archery Bow", now abandoned.

TECHNICAL FIELD

This invention relates to a type of arrow rest commonly known as overdraws, which mount to the riser portion of an archery bow and permit the use of shorter arrows than would otherwise be possible with an archery bow.

BACKGROUND OF THE INVENTION

Bow hunting and competitive target archery are both increasing in popularity as ever more sophisticated equipment is available. In the past twenty years, compound bows have replaced traditional recurve single-piece bows as the bow of choice for both serious hunters and competitive archers. Technology development of arrows has generally not kept pace with the bow technology, so that most advances in the sport have come about as a result of bow technology.

One of the few modifications to an arrow that will increase an archer's efficiency is to shorten the overall length of the arrow. A shorter arrow is faster (over 285 feet per second for a 20-inch arrow, versus about 230 feet per second with a conventional 32-inch arrow), and because it weighs less, follows a flatter trajectory. This makes range estimates less critical, minimizes the impact of this variable, and effectively increases the target or hitting area for the archer. Numerous manufacturers provide overdraw devices which position the support location for an arrow aft of the bow riser portion.

As shorter and shorter arrows have come into use, the support location for the arrow has moved to within the range of travel of the drawstring upon release, namely from the drawstring full-draw rear location to its forwardmost location upon release. All current overdraw systems usable with the shortest arrows suffer from the same defect: the drawstring necessarily strikes the overdraw apparatus on its forwardmost movement when the arrow is released. Furthermore, most all such overdraw devices interfere with the compound bow tension cables (draw cables) which also move forward relative to the bow upon drawstring release. The impact of the string and cables against the overdraw arrow rest produces significant wear of the cables and drawstring, causing their replacement more quickly than is otherwise desired. The impact also produces a significant impact noise which can frighten targeted animals and result in missed shots.

It is also postulated that such impact adversely affects the flight of the arrow as it leaves the bow. It would be desirable to produce an overdraw arrow rest apparatus that overcomes these drawbacks.

BRIEF DESCRIPTION OF THE DRAWINGS

Preferred embodiments of the invention are illustrated in the accompanying drawings, in which:

FIG. 1 is a perspective view of an arrow rest apparatus in accordance with the invention affixed to a compound archery bow.

DETAILED DESCRIPTION OF THE PREFERRED EMBODIMENTS

The following disclosure of the invention is submitted in furtherance with the constitutional purpose of the Patent Laws "to promote the progress of science and useful arts" (Article 1, Section 8).

Figure 2:
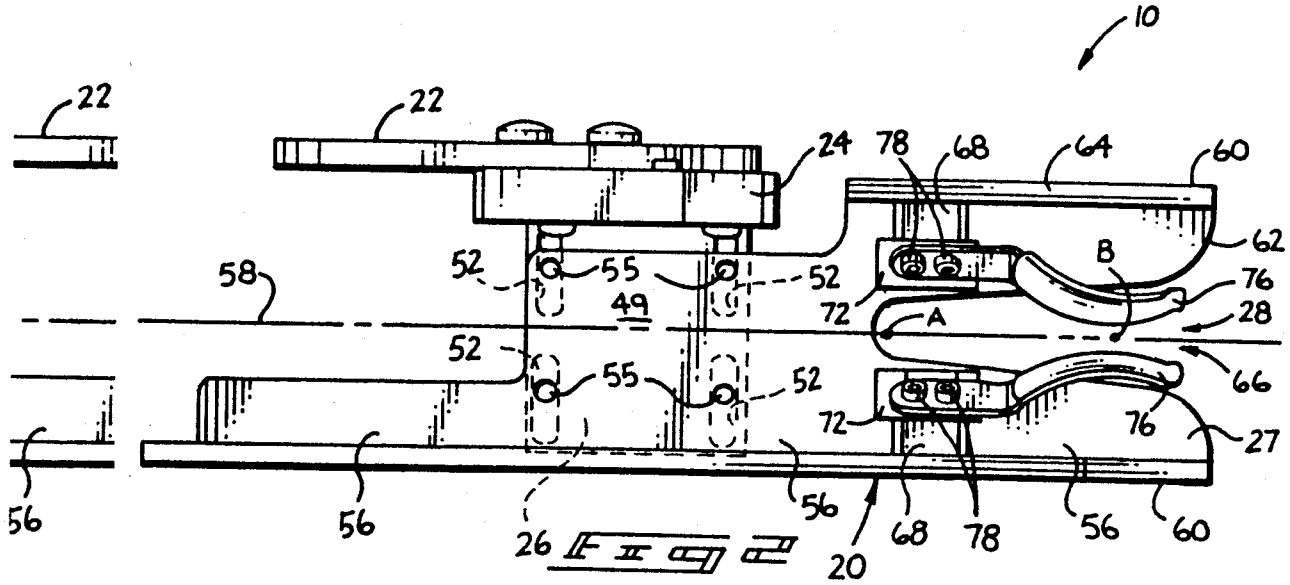
FIG. 2 is a top view of the apparatus of FIG. 1 illustrated removed from the archery bow.
Figure 7:
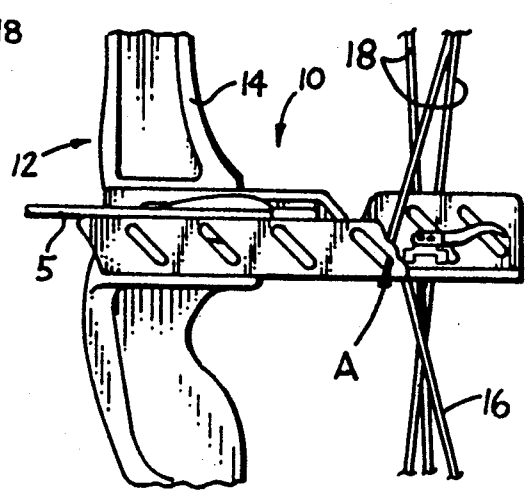
FIGS. 5–7 are sequential fragmentary side views of the apparatus of FIG. 1 mounted to an archery bow illustrating the relationship of the arrow, drawstring, and tension cables and the apparatus in operation.

Referring to FIGS. 1–7, a first embodiment arrow rest apparatus for mounting to a riser portion of an archery bow is indicated generally by reference numeral 10. Apparatus 10 is illustrated mounted to a right-hand compound archery bow 12 having a riser portion 14, a bowstring or drawstring 16, and tension cables 18 extending alongside drawstring 16. Drawstring 16 is adapted to travel upon release from a full-draw rearward location (off the pages in most views and not shown) to a forwardmost location "A" (FIGS. 2 and 7). The full-draw rearward location would be off the page in the right direction of the illustrations of FIGS. 1 and 2. Drawstring 16 is shown in an at-rest or relaxed location in FIG. 1. Bow 12 has a draw length equal to the distance between the at-rest location and the full-draw rearward location.

Arrow rest apparatus 10 comprises a body 20 constructed of four separate components 22, 24, 26 and 27 as will be more fully described below. These components are preferably constructed of metal, such as aluminum. Body 20 has a longitudinal length that is significantly less than the draw length of bow 12. Bow mounting means are provided for mounting body 20 relative to riser portion 14 of archery bow 12, as will also be more fully described below.

Body 20 includes an arrow support means 28 for supporting an arrow at a singular predetermined support location "B" (FIGS. 1, 2 and 5) aft of bow riser portion 14 as an arrow is drawn, held, and released with the drawstring. In the context of this document, the term "singular" means only one general support location located along the arrow path as it is drawn and shot from the bow. Singular predetermined support location B is located between the drawstring full-draw rearward location (not shown) and forwardmost location A. More specifically, predetermined support location B is located between the drawstring at-rest location and forwardmost location A. Adjustable mounting means are provided for enabling selective positioning of singular predetermined support location B forward and rearward relative to bow riser 14.

Arrow support means 28 and body 20 cooperatively provide passage means for allowing movement of drawstring 16 forwardly through and past singular predetermined support location B when drawstring 16 is released from its full-draw rearward location. Arrow support means 28 is removably mounted relative to body 20 for replacement upon wear, or for attachment of an alternate configuration arrow support.

Referring now more particularly to FIGS. 1–4, body first part 22 mounts directly to bow riser 14, with the combination of body parts 24, 26, and 27 being mounted relative to body part 22. Body parts 22 and 24 are usable with other of the assignee's arrow rest apparatus not constituting a part of this invention. Body part 22 is elongated, having upper and lower forwardly projecting portions 30, 32 respectively, which are received by a prefabricated recessed portion formed in bow riser 14. Of course, other means for mounting a body 20 relative to a bow could be provided. Portions 30 and 32 each include a hole 34 which receives a mounting bolt 36 which threads to riser portion 14.

Figure 4:
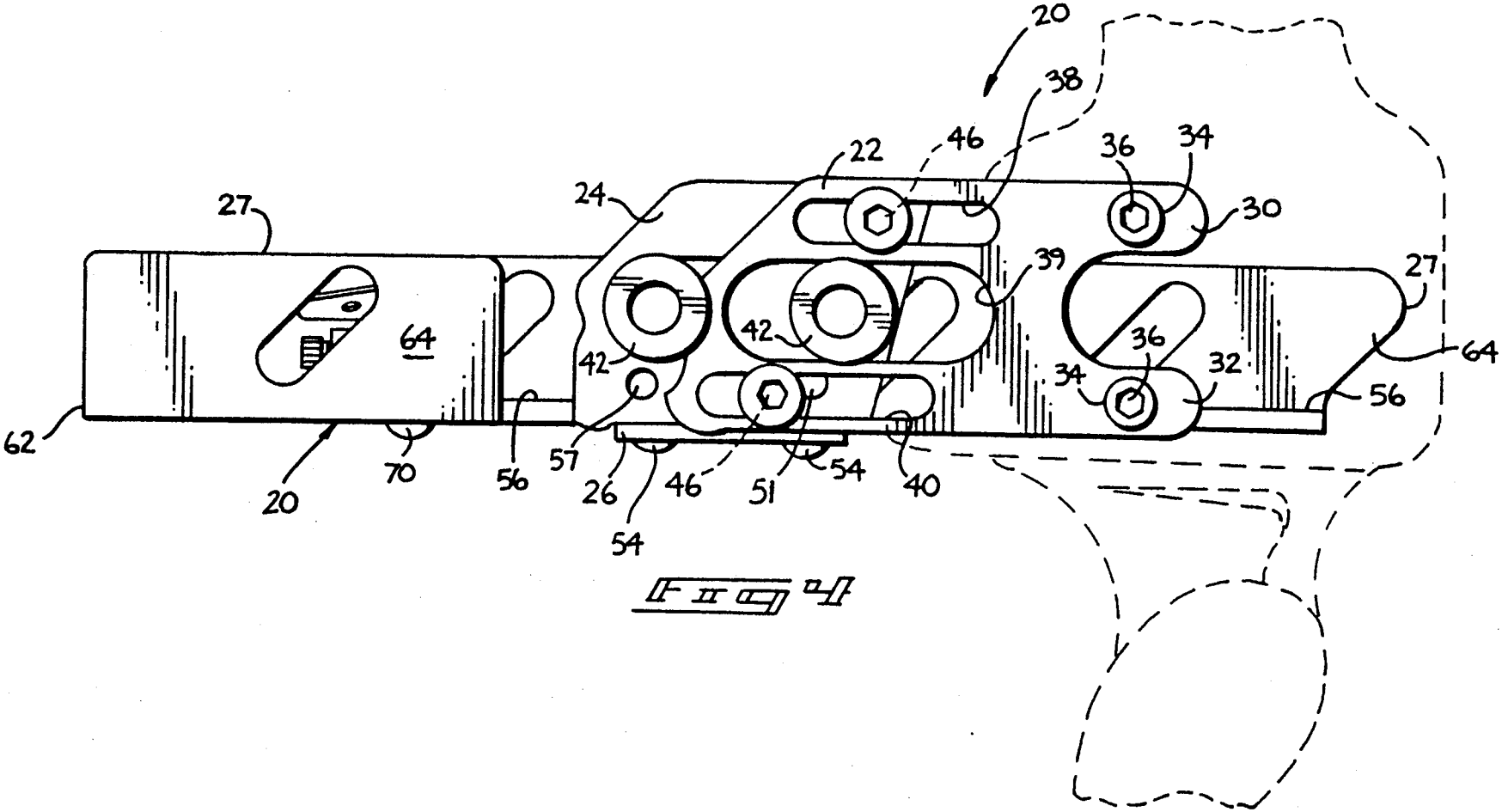
FIG. 4 is a rear side view of FIG. 2.

Three longitudinal slots 38, 39 and 40 are formed in the longitudinal rear portion of body part 22. Slots 38 and 40 are positioned at the upper and lower portions of body part 22, with a larger (wider) slot 39 being positioined therebetween. Slot 39 is adapted to selectively receive one or both of laterally projecting portions 42 on body second part 24. FIG. 4 illustrates only the fore projection 42 being received by slot 39.

Bolts 44 extend through first body part slots 38, 40 and thread into upper and lower threaded openings 46 of second body part 24. Loosening of bolts 44 enable first and second body parts 22, 24 respectively, to be slid longitudinally relative to one another. This enables selective positioning of singular predetermined support location B forward and rearward relative to bow riser 14 as will be apparent from the continuing discussion.

Fourth body part 27 is mounted to second body part 24 by an intermediate right-angle, plate-like body part 26. Body part 26 has a large horizontally oriented portion 49 and a short upwardly projecting right angle portion 48 (FIG. 1). Portion 48 is matingly received in a recess formed in second body part 24, and maintained relative thereto by a pair of bolts 50 which thread into holes 51 formed in part 24 (FIG. 4). Large portion 49 of body part 26 includes four transverse slots 52 (FIG. 2). Four short bolts 54 extend through the four slots 52 from underneath apparatus 10, and thread into holes 55 formed in fourth body part 27. Loosening and retightening of bolts 54 enables body part 27 to be laterally moved relative to bow riser 14. This provides a means for laterally moving arrow support means 28 relative to bow riser 14 to enable selective lateral positioning of singular predetermined arrow support location B.

Fourth body part 27 is longitudinally elongated having a generally planar lower portion or member 56, a longitudinal axis 58 (FIG. 2), opposing longitudinal sides 60, and a rear edge 62. Longitudinally elongated side guard members 64 rise longitudinally and integrally from sides 60 of planar lower member 56. A drawstring slot 66 extends from lower planar rear edge 62 to beyond forwardmost drawstring travel location A to accept drawstring 16 as it travels forward upon release.

Figure 3:
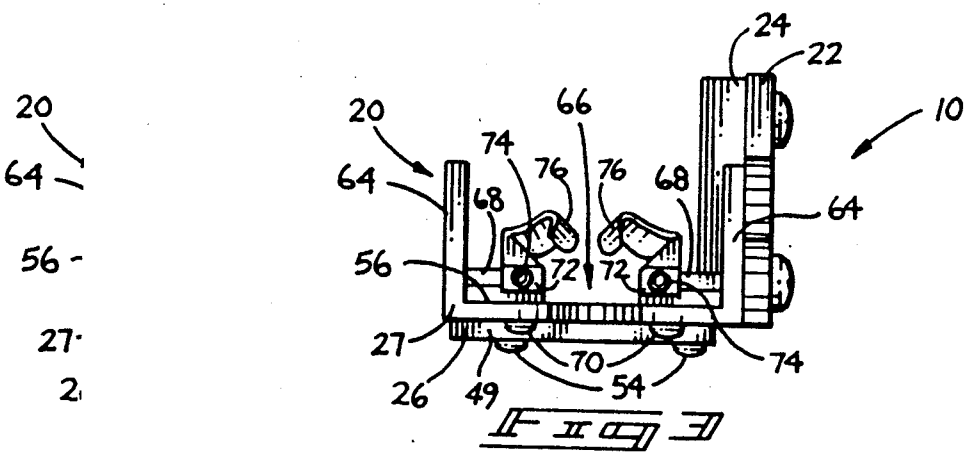
FIG. 3 is a right end view of FIG. 2.

Arrow support means 28 is positioned about slot 66 on planar portion 56 for supporting the arrow at the singular predetermined support location B. It comprises two male dovetail slides 68 which bolt by means of bolts 70 to part 27 on the opposite sides of slot 66 adjacent the forward end thereof. Female dovetail slides 72 are slidably received relative to male dovetails 68, and are adjustably positioned relative thereto by means of locking set screws 74 (FIG. 3).

A thin, spring-flexible removable arrow supporting member or arm 76 is bolted with a pair of bolts 78 to each of female dovetails 72, and extend in a rearward direction relative to body part 27 to support an arrow at support location B. The adjustability of female dovetail 72 relative to male dovetails 68 makes the two arrow supporting members 76 laterally adjustable relative to fourth body part 27, and toward and away from each other. This enables arms 76 to be adjustably separated by a space which is sufficiently wide and rearwardly open on the body to permit passage of the drawstring upon release from its full-drawn location to through and past singular predetermined support location between arms 76, yet the space is also sufficiently narrow for the two arms 76 to engage and support the opposite sides of the particular arrow shaft. Supporting members 76 extend rearward no further than the at-rest location of drawstring 16 so that they do not interfere with an archer's grasp of drawstring 16.

The various above described relative mountings of apparatus 10 relative to bow riser portion 14, and arrow support means 28 relative to body 20, enable selective positioning of predetermined support location B laterally and longitudinally relative to bow riser 14.

Figure 6:
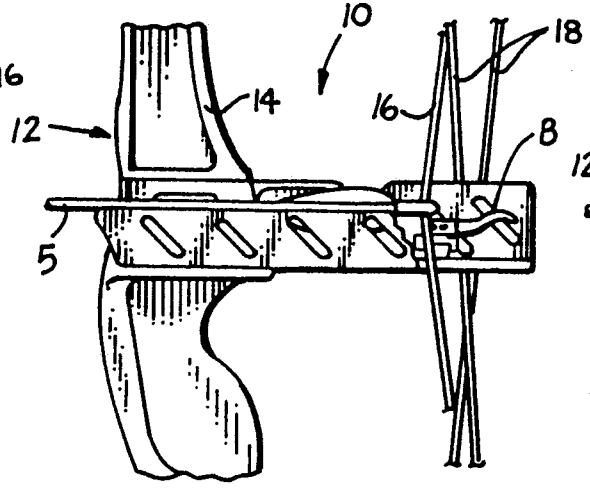
Figure 5:
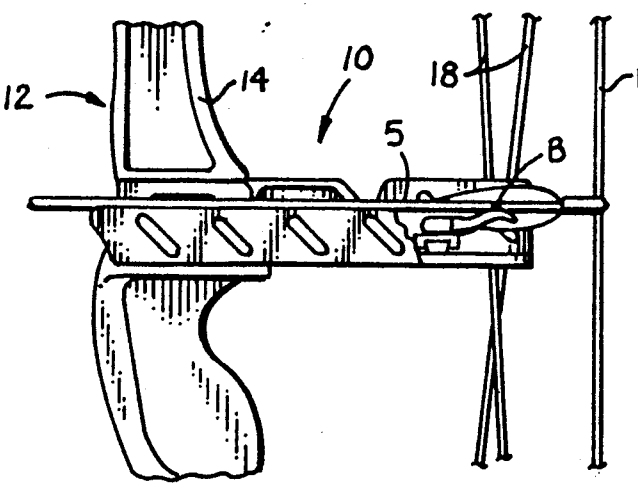

A description of the operation of apparatus 10 is provided with reference to FIGS. 5–7. FIG. 5 illustrates bow 12 in the loaded, uncocked condition supporting an arrow 5 by arms 76 at the user selected preselected support location B. Drawstring 16 would then be pulled rearwardly along with arrow 5, aim taken, and then the drawstring released. The arrow support means and passage means cooperatively accommodate passage of drawstring 16 past and through arrow support location B (FIG. 6) clear up to drawstring 16 forwardmost travel location A (FIG. 7). As is illustrated, compound bow tension cables 18 also travel longitudinally forward from their resting position (FIG. 5) upon forward travel of drawstring 16 to forwardmost location A.

Figure 8B:
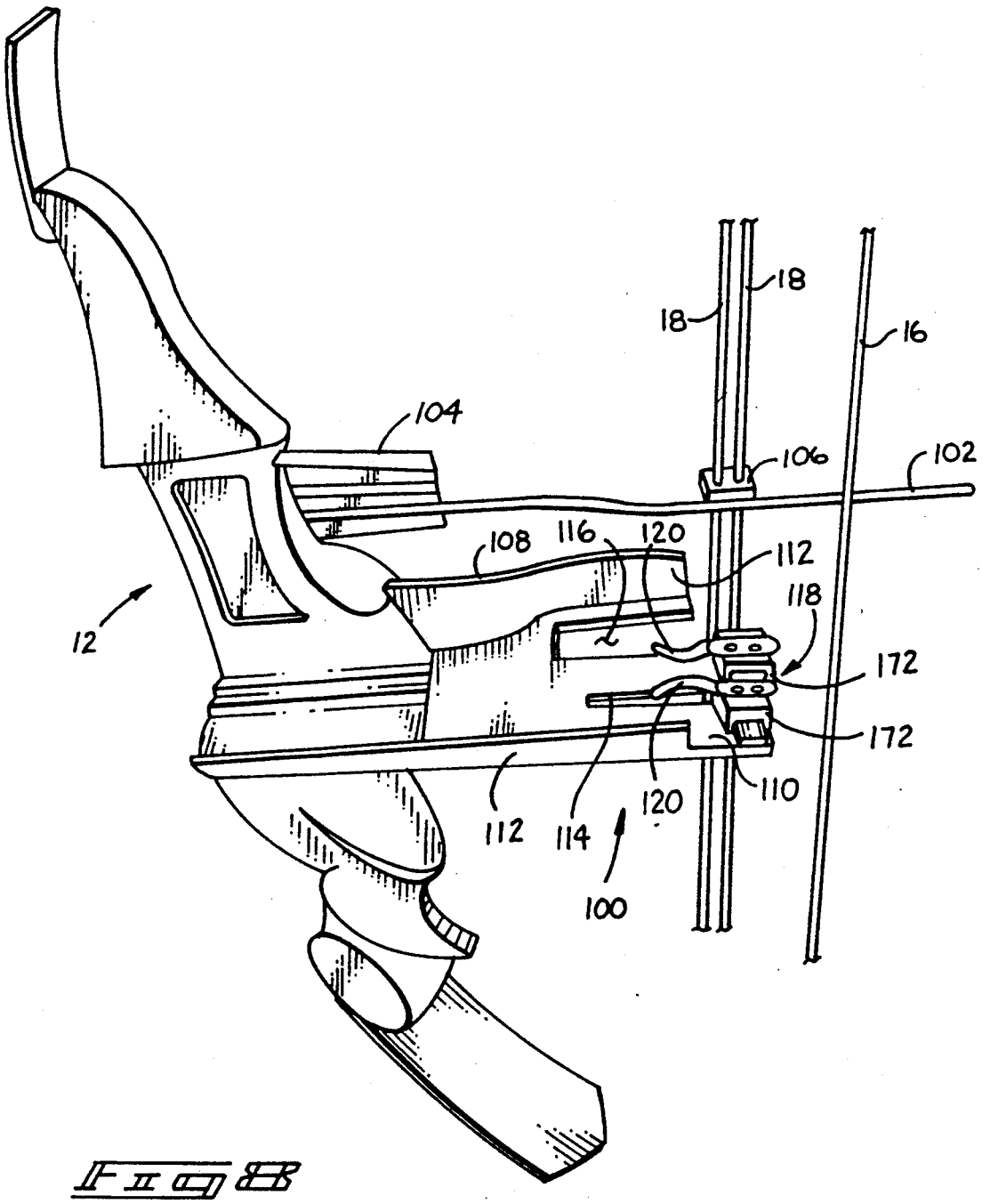
FIG. 8 is an isometric view of an alternate embodiment apparatus in accordance with the invention mounted to a compound bow.
Figure 9:
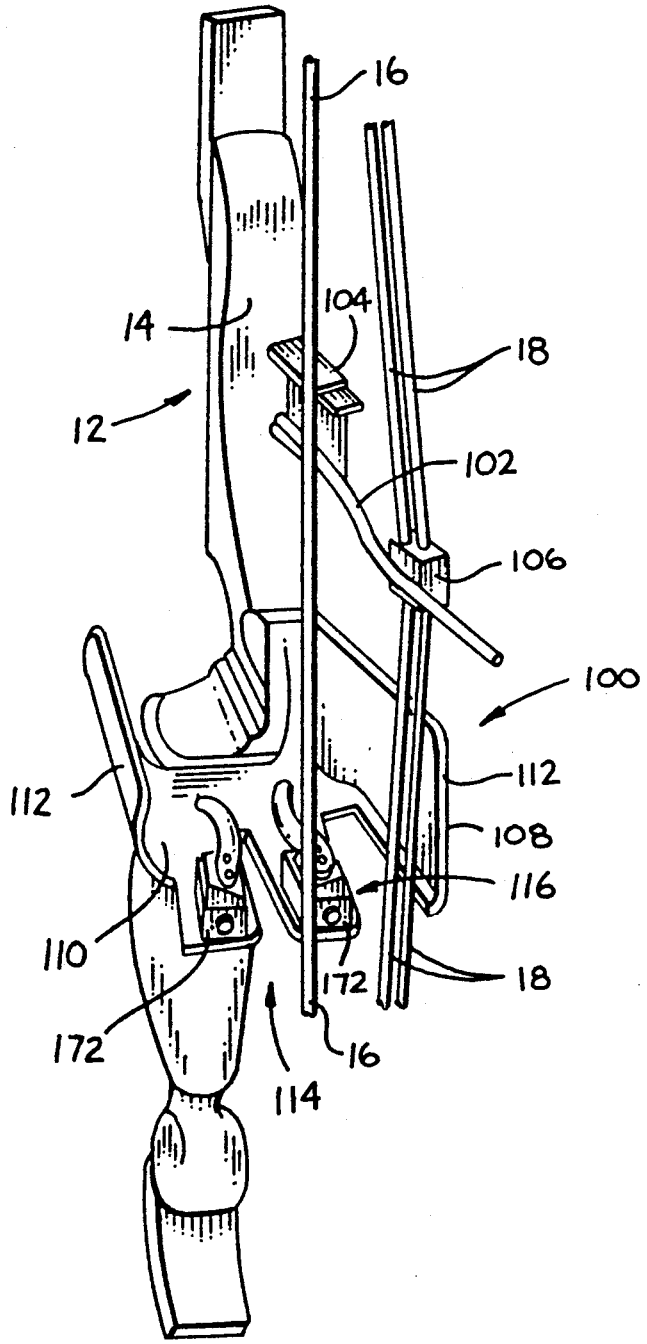
FIG. 9 is a rear perspective view of FIG. 8.

Referring to FIGS. 8 and 9, an alternate embodiment overdraw arrow rest apparatus 100 is illustrated affixed to a compound bow 12. Tension cables 18 are laterally held away from the line of shooting by a cable guard 102 which is affixed to riser 14 with a conventional cable guard bracket 104, as would also position cables 18 relative to the above described first embodiment. A slide member 106 is provided about tension cables 18 adjacent cable guard 102 to accommodate sliding of tension cables 18 relative thereto. Apparatus in accordance with the invention might also be constructed to provide the cable guard function and thereby eliminate the need for the conventional cable guard when using the apparatus.

Apparatus 100 is somewhat similar to apparatus 10 such that only some of the differences will be described. Apparatus 100 has a one piece body 108 which is configured to mount to bow riser 14 in the same manner as first body part 22 of apparatus 10. This provides an affixation means for affixing apparatus 100 to bow riser portion 14. Body 108 comprises a planer lower member 110 having a long dimension with a longitudinal axis perpendicular to the long dimension of the bow, like the first embodiment. Planar lower member 110 is contiguous with the remaining portions of body 108. A pair of side guard members 112 projects upwardly from the sides of lower member 110, forming a protective trough through which the arrow travels.

Lower member 110 is laterally wider than apparatus 10 of the first described embodiment, and is provided with a drawstring slot or void 114, and a draw cable slot or void 116 in lower member 110. These slots are positioned so that when an arrow is released from the bow, and the drawstring and tension cables travel forwardly, they will enter their respective slots and not contact or otherwise interfere with other components of apparatus 100. Accordingly the slots have a longitudinal length or depth which is sufficient to accommodate free forward and rearward movement of the respective string or cables upon release of the drawstring.

An arrow rest or arrow supporting means 118 is provided on opposite sides of drawstring slot 114, as was similarly provided with the first described embodiment. However here, an alternate method of mounting the pair of arrow rest members 120 to project forwardly on either side of drawstring slot 114 is illustrated. The precise construction of arrow support means 118, as with the first embodiment, effectively holds the arrow and all its components (shaft, broadhead, and fletching) for clearance above lower member 110, and is split to provide passage of drawstring 16 therebetween. Arms 120 and female dovetails 172 are mounted in the same manner to the first described embodiments to enable lateral adjustment relative thereto in body 108.

Figure 10:
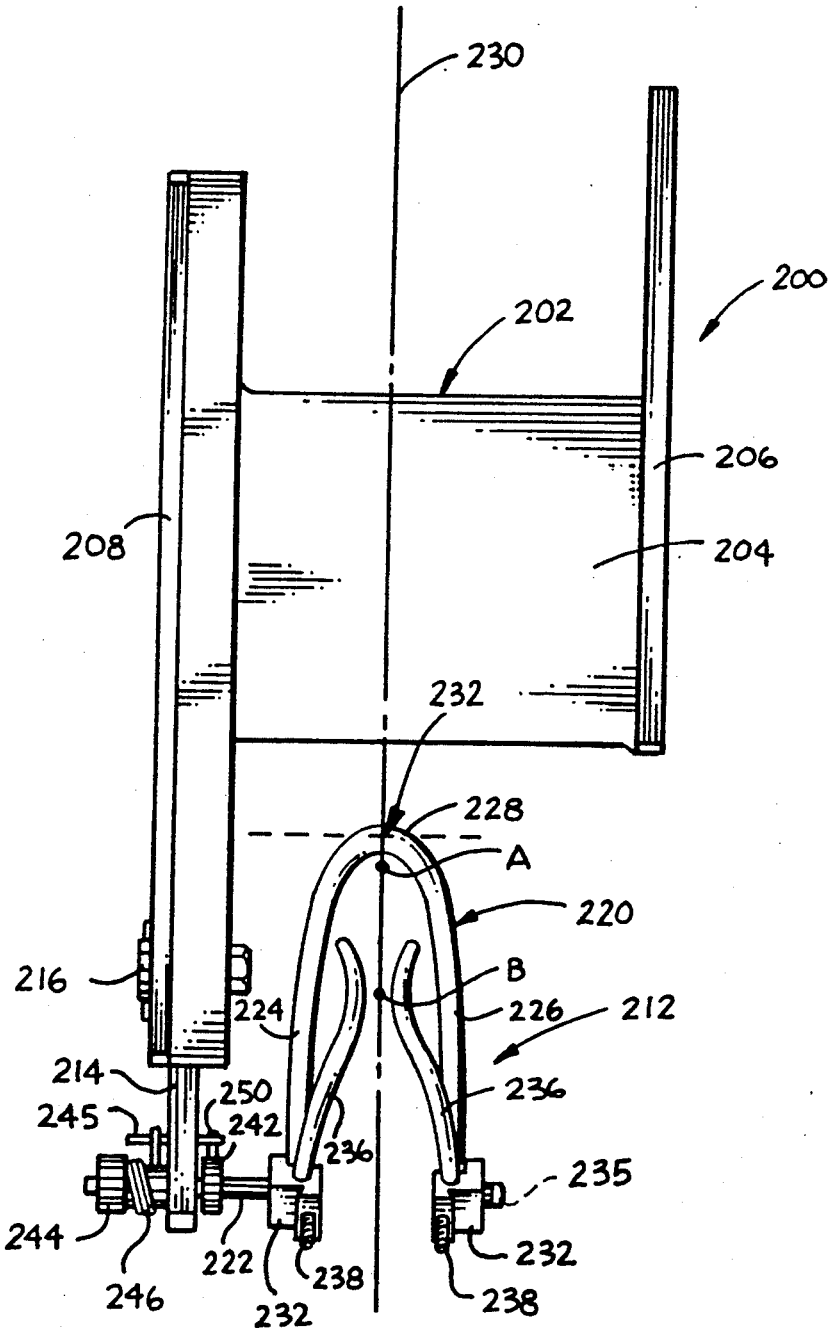
FIG. 10 is a top view of still another alternate embodiment apparatus in accordance with the invention.
Figure 11:
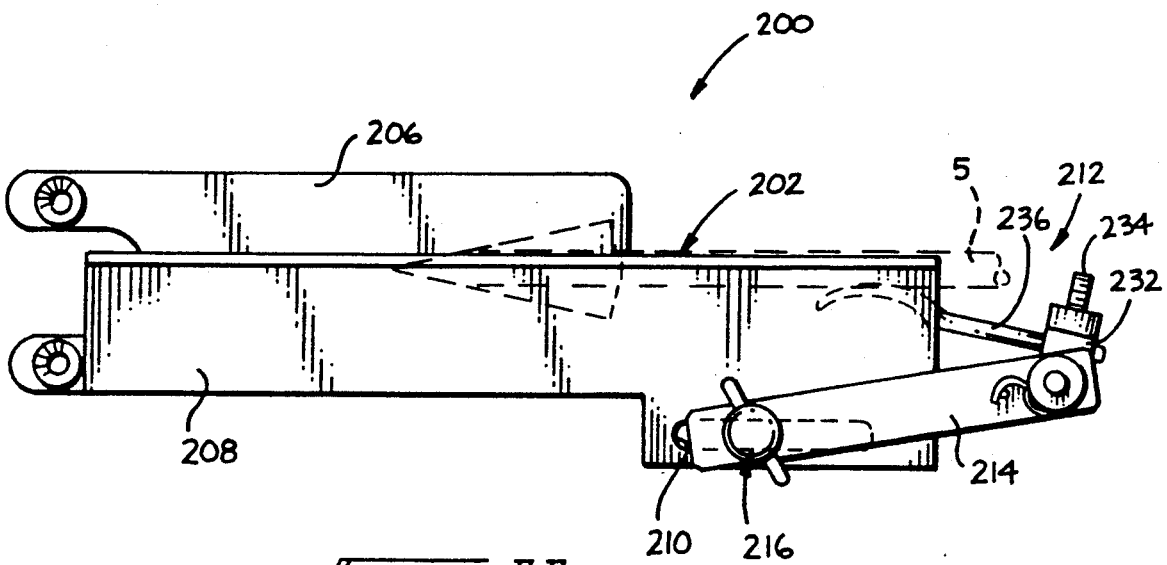

Yet another alternate embodiment arrow rest apparatus 200 is shown and described with reference to FIGS. 10–12. Apparatus 200 includes a longitudinally elongated body 202 which includes a lower planer member 204 and opposed upwardly projecting side guards 206 and 208. Side guard 206 also projects generally longitudinally forward relative to planar lower member 202, and is configured to mount to the bow riser portion in a manner similar to the above described first two embodiments. Side guard 208 projects generally rearward relative to planar member 204 and angles laterally outward relative thereto slightly. The lower rear portion of side guard 208 includes a longitudinally elongated slot 210 for mounting an arrow supporting means 212 relative to body 202.

Arrow support means 212 includes an elongated longitudinally oriented, rearwardly projecting mounting bar 214 which adjustably bolts to side guard 208 through slot 210 with a T-bolt and nut combination 216. A support bar or rod 218 is pivotally mounted relative to bar 214 and correspondingly body 202. Support bar 218 includes an inverted U, rod-like portion 220 having a laterally projecting portion 222 which pivotally extends through mounting bar 214 and an opposing shorter projection 235, as will be more fully described below. U-portion 220 is longitudinally elongated and oriented along the general longitudinal direction of body 202.

U-shaped portion 220 includes left and right side portions 224, 226 respectively, and a curved laterally extending portion 228 which joins with portions 224 and 226. Portion 228 extends generally laterally across or relative to body 202 and a path 230 along which an arrow will be propelled through the apparatus and from a bow. Portion 224 of U-shaped member 220 projects forwardly to a crossing location 232, defined by portion 228, which crosses arrow path 230 forwardly beyond drawstring forwardmost location A. An alternate configuration could of course be constructed whereby a U-like portion 220 is supported relative to body 202 forwardly of drawstring forwardmost location A, and projects rearwardly to support location B.

Figure 12:
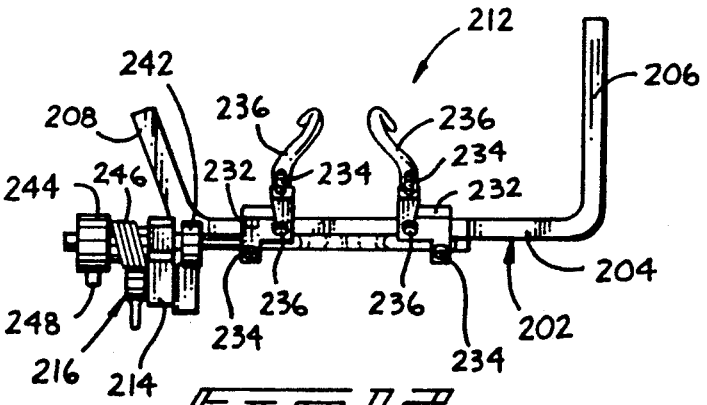
FIG. 12 is a rear end view of FIG. 10.

Mounting blocks 232 are pivotally mounted to portions 222 and 235 of rod 218, and there retained in a selected position by set screws 234 (FIG. 12). Two forwarding projecting, removable arrow supporting members 236 are mounted relative thereto to engage opposite sides of the arrow shaft for supporting the arrow at the predetermined support location B. Arms 236 are circular in cross section and retained within holes in blocks 232 with set screws 238. Rotatably adjusting arms 236 with set screws 238, and/or moving blocks 232 laterally relative to their support bar portions 222, 235 respectively, enables the spacing between arms 236 to be selectively varied.

Rod portion 222 is pivotally supported relative to support bar 215 in a manner similar to which assignee's prior art model number 2939 prong rest is pivotally supported. Such mounting includes an inner collar 242, an outer collar 244, a laterally projecting pin 245 and a biasing spring 246. Outer collar 244 is retained relative to rod portion 222 by means of a set screw 248. One end of coil spring 246 is secured in an opening of outer collar 244, and wraps therearound several times, and projects forwardly to rest against the outer portion of laterally projecting pin 245. This biases rod portion 222 in a clockwise direction as illustrated in FIG. 11. An elongated set screw 250 secures collar 242 relative to rod 222 and projects to engage the underside of pin 245.

Figure 11:
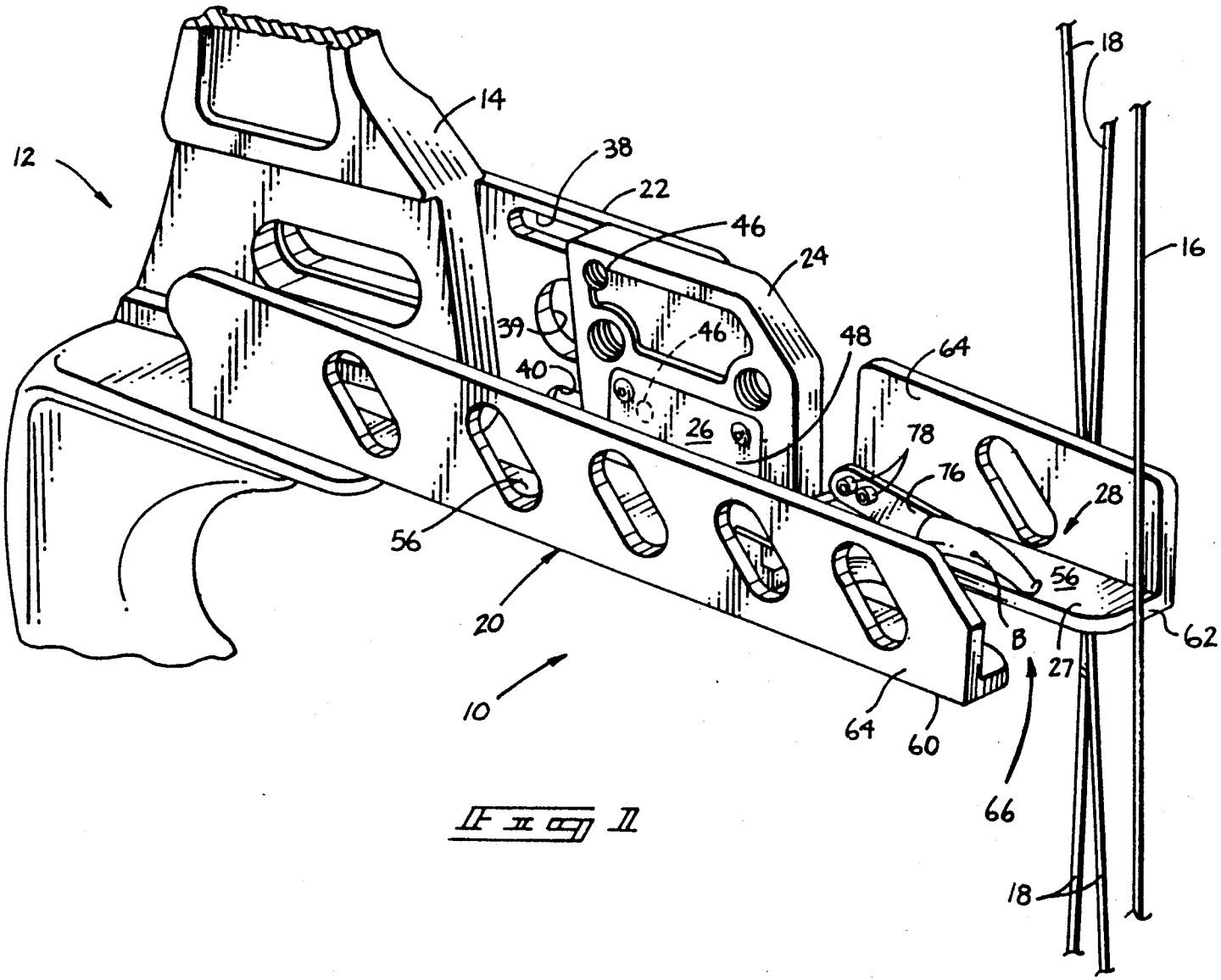
FIG. 11 is a left side view of FIG. 10.

This construction biases rod 222 to a first pivotal position for supporting an arrow 5 as illustrated in FIG. 11. Rod 222 is pivotal from the first pivotal position upon application of a force as might be imparted by a moving arrow which is sufficient to overcome the bias. Of course alternately, arrow supporting arms 236 could be constructed to be rather flexible, and rod 218 constructed to be nonpivotal relative to bar 214 and body 202. Further, portion 228 of U-portion 220 could also be constructed to include a laterally or other projecting portion which secures relative to body 202.

Figure 14:
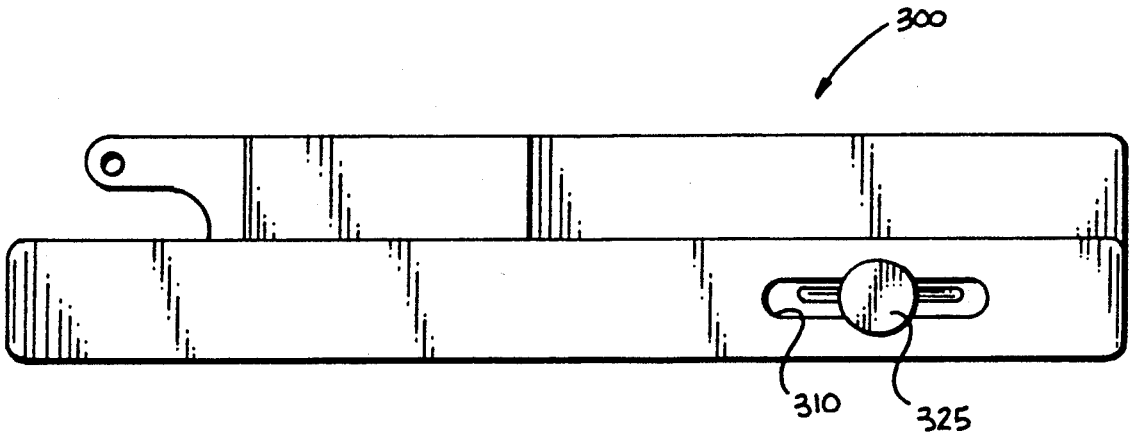
FIG. 14 is a left side view of FIG. 13.
Figure 15:
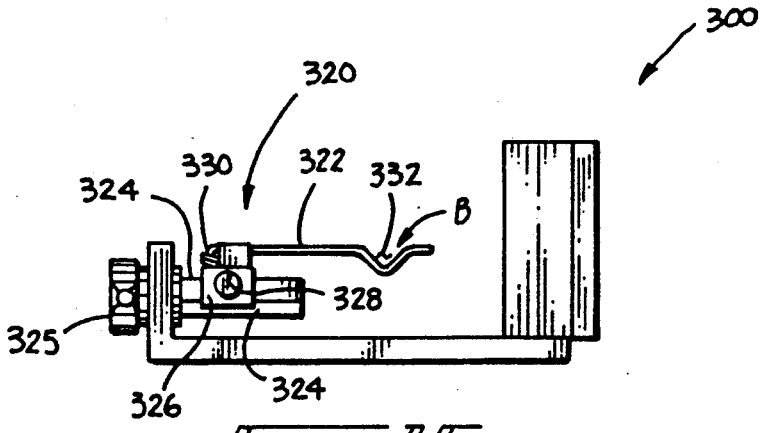
FIG. 15 is a rear end view of FIG. 13.

Yet another alternate embodiment apparatus 300 is described with reference to FIGS. 13–15. Here, an arrow support 320 comprises a pivotally mounted arm 322 which is positioned between the drawstring full draw rearward location and forwardmost travel location A to be struck by the drawstring and pivot forwardly out of the way. Arm 322 is sized and constructed to withstand repeated hits and be pivoted forwardly by the drawstring, yet also is replaceable upon excessive wear.

More particularly, arrow support 320 includes a male dovetail slide 324 which is secured relative to the body of apparatus 300 by a T-bolt 325 which extends through a slot 310. A female dovetail slide 326 slidably and adjustably mounts relative to male dovetail slide 324 by means of a set screw 328. This enables lateral positioning of support location B relative to the bow. Arm 322 includes a short right angle portion which projects downwardly and is received within a vertical hole formed in female dovetail slide 326. A detent can be formed in the upper surface of female dovetail slide 326 where arm 322 crosses relative thereto to provide an natural indexing location for maintaining arm 322 in a lateral orientation for supporting the arrow for shooting.

A coil spring 330 can be provided within or immediately above the hole formed in the female dovetail slide for bringing arm 322 back to its lateral position as shown after it has been struck by an arrow and pivoted forwardly. Alternately, the spring could be omitted with the user manually resetting arm 322 after each shot. Arm 322 also includes a downward V-notched portion 332 for laterally orienting the arrow for shooting.

Figure 13:
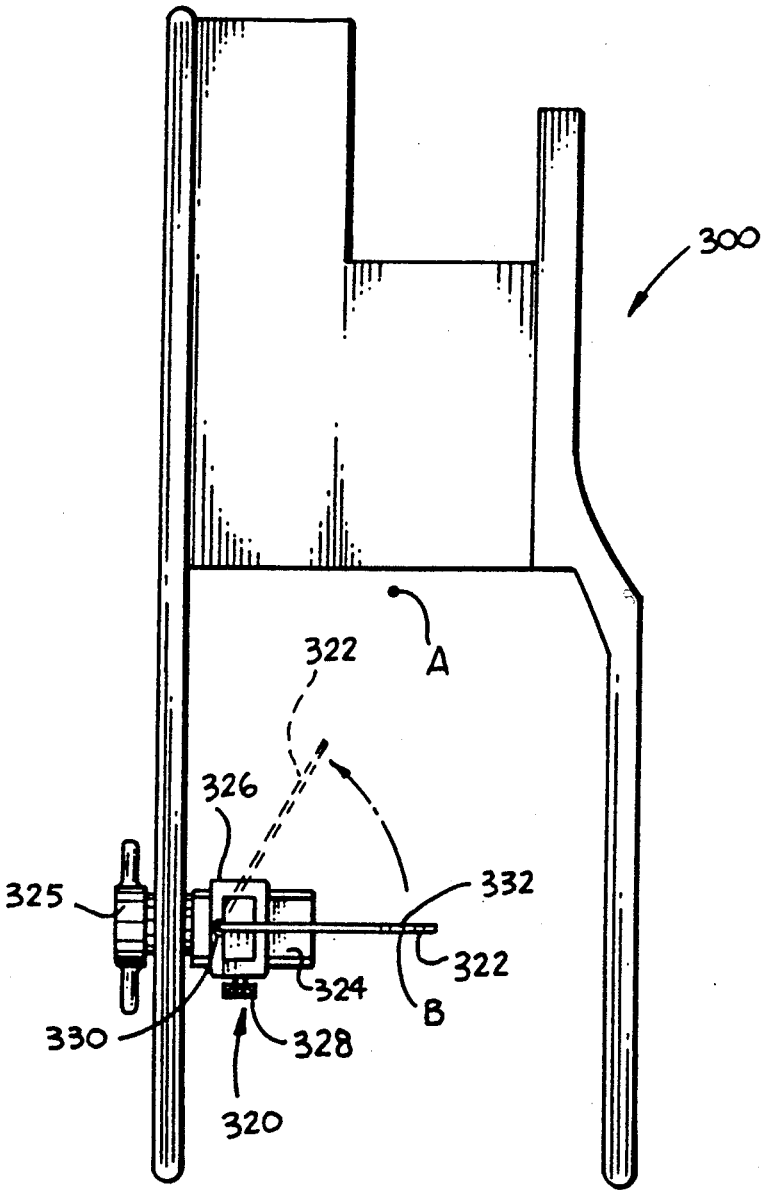
FIG. 13 is a top or overhead view of still another alternate embodiment apparatus in accordance with the invention.

Upon arrow release, the arrow fletching and/or drawstring would strike arm 322 and cause it to pivot forwardly to accommodate movement of the bow string to location A, as is best illustrated in FIG. 13. Spring 330 would preferably be designed to provide a sufficiently low biasing force to enable the drawstring to retract rearwardly before arm 322 pivots rearwardly.

Figure 16:
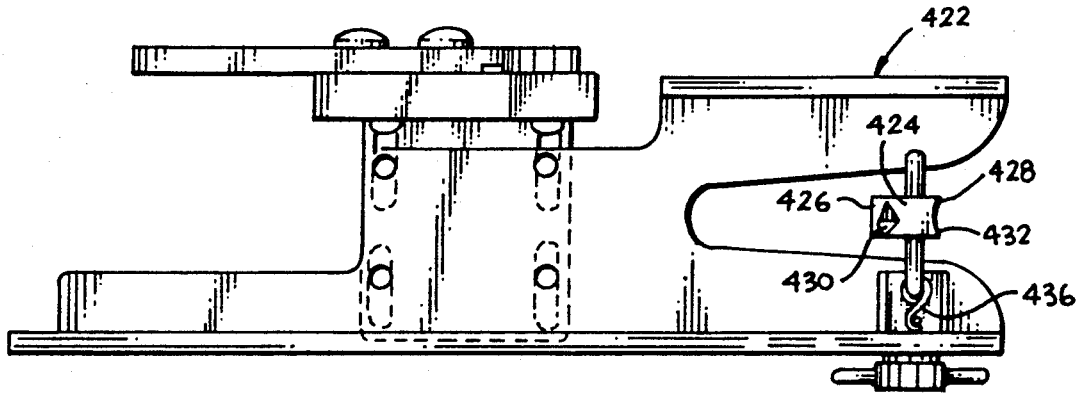
FIG. 16 is a top view of another alternate embodiment apparatus in accordance with the invention.
Figure 17:
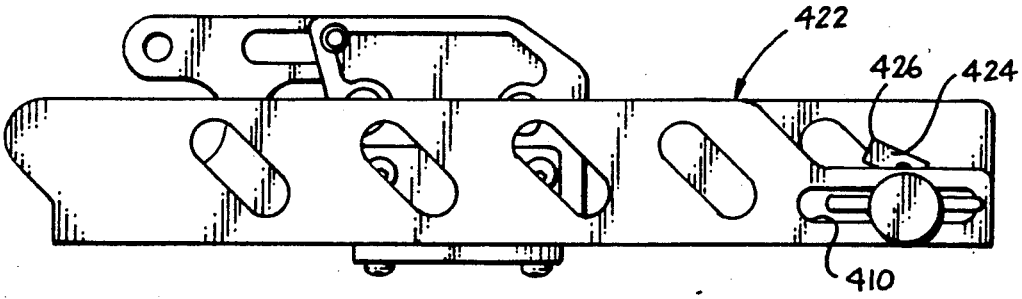
FIG. 17 is a left side view of FIG. 16.
Figure 18:
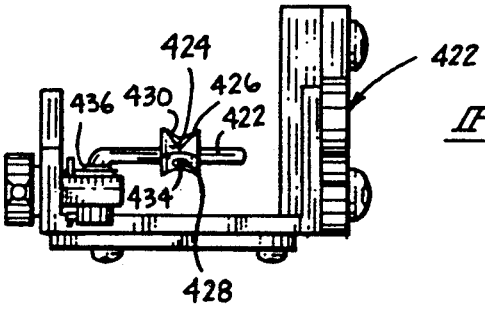
FIG. 18 is a right end view of FIG. 16.

Yet another alternate embodiment apparatus 400 is illustrated in FIGS. 16–18. Apparatus 400 has greatest similarity in its arrow support to the immediately above described embodiment, and greatest similarity in its mounting to a bow to the first described embodiment. With apparatus 400, a laterally projecting pivotally mounted arm 422 includes an arrow support block 424 which is laterally adjustable relative to arm 422. Block 424 has a forward end 426 and a rear end 428. Forward end 426 has an arrow V-notch 430 which is sized to support the arrow to be shot. Rearward end 428 has a rounded drawstring notch 432 which is sized to receive and be hit by the drawstring upon its release and forward travel. In this manner, the drawstring strikes the pivotally mounted arm through block 424. A set screw 434 is flushly mounted within rounded slot 432 and engages pivoting arm 422 for selectively positioning the angle of support block 424 relative to arm 422. A spring 436 can be provided as illustrated for returning arm 422 to its ready position after being stuck by an arrow and/or drawstring.

In compliance with the statute, the invention has been described in language more or less specific as to structural features. It is to be understood, however, that the invention is not limited to the specific features shown and described, since the means and construction disclosed comprise preferred forms of putting the invention into effect. The invention is, therefore, claimed in any of its forms or modifications within the proper scope of the appended claims appropriately interpreted in accordance with the doctrine of equivalents.

What is claimed is:

1. An arrow rest apparatus for mounting to a riser portion of an archery bow to support an arrow aft of the riser portion, the archery bow having a drawstring which is adapted to have an at-rest position and to travel upon release from a full-draw rearward location to a forwardmost location, the archery bow having a draw length, the arrow rest apparatus comprising:

a body having a longitudinal length, the body length being significantly less than the draw length;

bow mounting means for mounting the body relative to the riser portion of an archery bow;

arrow support means on the body for supporting an arrow at a singular predetermined support location aft of the bow riser portion throughout drawing, holding and releasing of an arrow, the singular predetermined support location being stationary with respect to the riser portion throughout drawing, holding and releasing of an arrow and being located between the drawstring full-draw rearward location and the forwardmost location, the arrow support means being removably mounted to the body for replacement;

the arrow support means and body comprising passage means for allowing movement of the drawstring forwardly through and past the singular predetermined support location when the drawstring is released, the passage means being rearwardly open to enable drawing of the bowstring rearwardly beyond both the body and the arrow support means; and adjustable mounting means for enabling selective positioning of the singular predetermined support location forward and rearward relative to the bow riser.

2. The arrow rest apparatus of claim 1 wherein the adjustable mounting means includes means for laterally moving the arrow support means relative to the bow riser to enable selective lateral positioning of the singular predetermined support location.

3. An arrow rest apparatus for mounting to a riser portion of a compound archery bow to support an arrow aft of the riser portion, the archery bow having a drawstring which is adapted to travel upon release from a full-draw rearward location to a forwardmost location, and having tension cables extending alongside the drawstring, the arrow rest apparatus comprising:

a body;

bow mounting means for mounting the body relative to the riser portion of an archery bow;

arrow support means on the body for supporting an arrow at a singular predetermined support location aft of the bow riser portion as the arrow is drawn, held, and released with the drawstring, the singular predetermined support location being located between the drawstring full-draw rearward location and the forwardmost location, the arrow support means being removably mounted relative to the body for replacement;

the arrow support means and body comprising passage means for allowing movement of the drawstring forwardly through and past the singular predetermined support location when the drawstring is released;

a tension cable void in the body which receives the tension cables, the tension cable void having a length which is sufficient to accommodate free forward and rearward movement of the tension cables upon drawing and release of the drawstring; and adjustable mounting means for enabling selective positioning of the singular predetermined support location forward and rearward relative to the bow riser.

4. The arrow rest apparatus of claim 1 wherein the arrow support means comprises two removable arrow supporting members which engage opposite sides of an arrow shaft at the singular predetermined support location;

the two members being separated from one another by a space, the space being sufficiently wide and being rearwardly open on the body to permit passage of the drawstring upon release from the full-draw location to through and past the singular predetermined support location between the two arrow supporting members, yet the space also being sufficiently narrow for the two members to engage and support the opposite sides of the arrow shaft.

5. The arrow rest apparatus of claim 4 wherein the two removable arrow supporting members extend in a rearward direction relative to the body and extend to the singular predetermined support location.

6. The arrow rest apparatus of claim 4 wherein the two removable arrow supporting members are laterally adjustable relative to the body and toward and away from each other.

7. The arrow rest apparatus of claim 4 wherein the adjustable mounting means includes means for laterally moving the arrow support means relative to the bow riser to enable selective lateral positioning of the singular predetermined support location.

8. The arrow rest apparatus of claim 4 wherein the two removable arrow support members extend in a rearward direction relative to the body and extend to the singular predetermined support location, the singular predetermined support location being forward of the at-rest location of the drawstring.

9. The arrow rest apparatus of claim 4 wherein the two removable arrow supporting members extend in a rearward direction relative to the body and extend to the singular predetermined support location, the support members not extending rearward beyond the at-rest location of the drawstring.

10. An arrow rest apparatus for mounting to a riser portion of an archery bow to support an arrow aft of the riser portion, the archery bow having a drawstring which is adapted to travel upon release from a full-draw rearward location to a forwardmost location, the arrow rest apparatus comprising:

a body;

bow mounting means for mounting the body relative to the riser portion of an archery bow;

arrow support means on the body for supporting an arrow at a singular predetermined support location aft of the bow riser portion as the arrow is drawn, held, and released with the drawstring, the singular predetermined support location being located between the drawstring full-draw rearward location and the fowardmost location, the arrow support means being removably mounted relative to the body for replacement;

the arrow support means and body comprising passage means for allowing movement of the drawstring forwardly through and past the singular predetermined support location when the drawstring is released;

adjustbale mounting means for enabling selective positioning of the singular predetermined support location forward and rearward relative to the bow riser;

the arrow support means and passage means comprising a support bar extending generally across the body and a path along which an arrow will be propelled from the bow, the support bar including a portion which projects to a crossing location positioned forwardly beyond the singular predetermined support location and across the arrow path, the crossing location being forward of the drawstring forwardmost location; and the arrow support means and passage means further comprising two removable arrow supporting members mounted relative to the support bar to engage opposite sides of an arrow shaft at the singular predetermined support location and support the arrow and all its components for clearance above the support bar, the two members being separated from one another by a space, the space being sufficiently wide and being rearwardly open to permit passage of the drawstring upon release from the full-draw location to through and past the singular predetermined support location between the two arrow supporting members, yet the space also being sufficiently narrow for the two members to engage and support the opposite sides of the arrow shaft.

11. An arrow rest apparatus for mounting to a riser portion of an archery bow to support an arrow aft of the riser portion, the archery bow having a drawstring which is adapted to travel upon release from a full-draw rearward location to a forwardmost location, the arrow rest apparatus comprising:

a body;

bow mounting means for mounting the body relative to the riser portion of an archery bow;

arrow support means on the body for supporting an arrow at a singular predetermined support location aft of the bow riser portion as the arrow is drawn, held, and released with the drawstring, the singular predetermined support location being located between the drawstring full-draw rearward location and the forwardmost location, the arrow support means being removably mounted relative to the body for replacement;

the arrow support means and body comprising passage means for allowing movement of the drawstring forwardly through and past the singular predetermined support location when the drawstring is released;

adjustbale mounting means for enabling selective positioning of the singular predetermined support location forward and rearward relative to the bow riser;

wherein the arrow support means and passage means comprise:

a rod pivotally mounted relative to the body, the rod being biased to a first pivotal position for supporting an arrow and being pivotal from the first pivotal position upon application of a force sufficient to overcome the bias;

the rod including a portion which projects forwardly to a crossing location positioned forwardly beyond the singular predetermined support location and there across the arrow path, the crossing location being forward of the drawstring forwardmost location; and two removable arrow supporting members being mounted relative to the rod to engage opposite sides of an arrow shaft at the singular predetermined support location and support the arrow and all its components for clearance above the rod, the two members being separated from one another by a space, the space being sufficiently wide and being rearwardly open to permit passage of the drawstring upon release from the full-draw location to through and past the singular predetermined support location between the two arrow supporting members, yet the space also being sufficiently narrow for the two members to engage and support the opposite sides of the arrow shaft.

12. An arrow rest apparatus for mounting to a riser portion of a compound archery bow to support an arrow aft of the riser portion, the archery bow having a drawstring which is adapted to travel upon release from a full-draw rearward location to a forwardmost location, and having tension cables extending alongside the drawstring, the arrow rest apparatus comprising:

a body;

bow mounting means for mounting the body relative to the riser portion of an archery bow;

arrow support means on the body for supporting an arrow at a singular predetermined support location aft of the bow riser portion as the arrow is drawn, held, and released with the drawstring, the singular predetermined support location being located between the drawstring full-draw rearward location and the forwardmost location, the arrow support means being removably mounted relative to the body for replacement;

the arrow support means and body comprising passage means for allowing movement of the drawstring forwardly through and past the singular predetermined support location when the drawstring is released;

a tension cable void in the body which receives the tension cables, the tension cable void having a length which is sufficient to accommodate free forward and rearward movement of the tension cables upon drawing and release of the drawstring;

adjustable mounting means for enabling selective positioning of the singular predetermined support location forward and rearward relative to the bow riser;

the arrow support means comprising two removable arrow supporting members which engage opposite sides of an arrow shaft at the singular predetermined support location; and the two members being separated from one another by a space, the space being sufficiently wide and being rearwardly open on the body to permit passage of the drawstring upon release from the full-draw location to through and past the singular predetermined support location between the two removable arrow supporting members, yet the space also being sufficiently narrow for the two members to engage and support the opposite sides of the arrow shaft.

13. The arrow rest apparatus of claim 12 wherein the two removable arrow supporting members extend in a rearward direction relative to the body and extend to the singular predetermined support location.

14. The arrow rest apparatus of claim 12 wherein the two removable arrow support members are laterally adjustable relative to the body and toward and away from each other.

15. An arrow rest apparatus for mounting to a riser portion of an archery bow to support an arrow aft of the riser portion, the archery bow having a drawstring which is adapted to travel upon release from a full-draw rearward location to a forwardmost location, the arrow rest apparatus comprising:

a body;

bow mounting means for mounting the body relative to the riser portion of an archery bow;

arrow support means on the body for supporting an arrow at a singular predetermined support location aft of the low riser portion as the arrow is drawn, held, and released with the drawstring, the singular predetermined support location being located between the drawstring full-draw rearward location and the forwardmost location, the arrow support means being removably mounted relative to the body for replacement;

the arrow support means and body comprising passage means for allowing movement of the drawstring forwardly through and past the singular predetermined support location when the drawstring is released;

adjustable mounting means for enabling selective positioning of the singular predetermined support location forward and rearward relative to the bow riser and;

wherein the arrow support means comprises a pivotally mounted arm that pivots forwardly upon being struck by the drawstring, the pivotally mounted arm being positioned between the drawstring full-draw rearward location and drawstring forwardmost location, the arm being sized and constructed to be repeatedly pivoted forward by the drawstring.

16. The arrow rest apparatus of claim 15 further comprising an arrow support block positioned on the pivotally mounted arm, the support block having a forward end and a rearward end, the forward end having an arrow notch sized to support the arrow to be shot, the rearward end having a drawstring notch sized to receive and be hit by the drawstring upon its release.

17. The arrow rest apparatus of claim 16 wherein the arrow support block is laterally adjustable relative to the arm to enable selective lateral positioning of the block and singular predetermined support location.

18. An arrow rest apparatus for mounting to a riser portion of an archery bow to support an arrow aft of the riser portion, the archery bow having a drawstring which is adapted to travel upon release from a full-draw rearward location to a forwardmost location, the arrow rest apparatus comprising:

a body;

bow mounting means for mounting the body relative to the riser portion of an archery bow;

the body including a generally planar lower member having a longitudinal axis, longitudinal sides and a rear edge;

side guard members rising from the sides of the lower member;

a drawstring slot being provided in the lower member, the drawstring slot extending from the rear edge and being rearwardly open to accept the drawstring upon its forward travel upon release of the drawstring and to enable drawing of the bowstring rearwardly beyond both the body and the arrow support means; and arrow support means on the body for supporting an arrow at a singular predetermined support location aft of the bow riser portion as the arrow is drawn, held, and released with the drawstring, the arrow and all its components being supported above the generally planar lower member for clearance, the singular predetermined support location being located between the drawstring full-draw rearward location and the forwardmost location, the arrow support means being removably mounted relative to the body for replacement.

19. The arrow rest apparatus of claim 18 wherein the generally planar lower member is laterally adjustable relative to the bow mounting means.

20. The arrow rest apparatus of claim 18 wherein the arrow support means comprises two removable arrow supporting member which engage opposite sides of an arrow shaft at the singular predetermined support location;

the two members being separated from one another by a space, the space being sufficiently wide and being rearwardly open on the body to permit passage of the drawstring upon release from the full-draw location to through and past the singular predetermined support location between the two arrow supporting members, yet the space also being sufficiently narrow for the two members to engage and support the opposite sides of the arrow shaft.

21. The arrow rest apparatus of claim 20 wherein the two removable arrow supporting members extend in a rearward direction relative to the body and extend to the singular predetermined support location.

22. The arrow rest apparatus of claim 20 wherein the two removable arrow supporting members are laterally ajustable relative to the body and toward and away from each other.

23. The arrow rest apparatus of claim 20 further clarified by the drawstring having an at-rest location, wherein the two removable arrow supporting members extend in a rearward direction relative to the body and extend to the singular predetermined support location, the support members not extending rearward beyond the at-rest location of the drawstring.

24. An arrow rest apparatus for mounting to a riser portion of a compound archery bow to support an arrow aft of the riser portion, the archery bow having a drawstring which is adapted to travel upon release from a full-draw rearward location to a forwardmost location and having tension cables extending alongside the drawstring, the arrow rest apparatus comprising:

a body;

bow mounting means for mounting the body relative to the riser portion of an archery bow;

the body including a generally planar lower member having a longitudinal axis, longitudinal sides and a rear edge;

side guard members rising from the sides of the lower member;

a drawstring slot being provided in the lower member, the drawstring slot extending from the rear edge to accept the drawstring upon its forward travel upon release of the drawstring;

a tension cable slot provided in the lower member and extending from the rear edge, the tension cable slot receiving the tension cables; and arrow support means on the body for supporting an arrow at a singular predetermined support location aft of the bow riser portion as the arrow is drawn, held, and released with the drawstring, the arrow and all its components being supported above the generally planar lower member for clearance, the singular predetermined support location being located between the drawstring full-draw rearward location and the forwardmost location, the arrow support means being removably mounted relative to the body for replacement.

25. An arrow rest apparatus for mounting to a rise portion of an archery bow to support an arrow aft of the riser portion, the archery bow having a drawstring which is adapted to travel upon release from a full-draw rearward location to a forward location, the arrow rest apparatus comprising:

a body;

bow mounting means for mounting the body relative to the bow riser portion;

arrow support means on the body for supporting an arrow at a singular predetermined support location aft of the bow riser portion as the arrow is drawn, held, and released with the drawstring, the singular predetermined support location being located between the drawstring full-draw rearward location and the forwardmost location, the arrow support means being removably mounted relative to the body for replacement;

the arrow support means and body comprising passage means for allowing movement of the drawstring forwardly through and past the singular predetermined support location when the drawstring is released; and the arrow rest support means and passage means comprising:

a support bar extending generally across the body and a path along which an arrow will be propelled from the bow, the support bar including a portion which projects a crossing location positioned forwardly beyond the singular predetermined support location and across the arrow path, the crossing location being forward of the drawstring forwardmost location; and two removable arrow supporting members being mounted relative to the support bar to enage opposite sides of an arrow shaft at the singular predetermined support location and to support the arrow and all its components for clearance above the support bar, the two members being separated from one another by a space, the space being sufficiently wide and being rearwardly open to permit passage of the drawstring upon release from the full-draw location to through and past the singular predetermined support location between the two arrow supporting members, yet the space also being sufficiently narrow for the two members to engage and support the opposite sides of the arrow shaft.

26. The arrow rest apparatus of claim 25 wherein the support bar is pivotally mounted relative to the body, and said portion projects forwardly to the crossing location.

27. An arrow rest apparatus for mounting to a riser portion of an archery bow to support an arrow aft of the riser portion, the archery bow having a drawstring which is adapted to travel upon release from a full-draw rearward location to a forwardmost location, the arrow rest apparatus comprising:

a body;

bow mounting means for mounting the body relative to the riser portion of an archery bow;

arrow support means on the body for supporting an arrow at a singular predetermined support location aft of the bow riser portion as the arrow is drawn, held, and released with the drawstring, the singular predetermined support location being located between the drawstring full-draw rearward location and the forwardmost location, the arrow support means comprising a pivotally mounted arm that pivots forwardly upon being struck by the drawstring, the pivotally arm being positioned between the drawstring full-draw rearward location and the drawstring forwardmost location, the arm being sized and constructed to be repeatedly pivoted forward by the drawstring; and the arrow support means and body comprising passage means for allowing movement of the drawstring forwardly through and past the singular predetermined support location when the drawstring is released.

28. The arrow rest apparatus of claim 27 further comprising an arrow support block positioned on the pivotally mounted arm, the support block having a forward end and a rearward end, the forward end having an arrow notch sized to support the arrow to be shot, the rearward end having a drawstring notch sized to receive and be hit by the drawstring upon its release.

29. The arrow rest apparatus of claim 28 wherein the arrow support block is laterally adjustable relative to the arm to enable selective lateral positioning of the block and singular predetermined support location.

30. An overdraw apparatus for affixation to a riser portion of an archery bow having a drawstring and at least one draw cable, the apparatus comprising:

a. affixation means for affixing the apparatus to the riser portion;

b. a planar lower member contiguous with the affixation means and having a longitudinal axis, a rear edge, and sides;

c. side guard members rising vertically from the sides of the lower member;

d. a draw cable slot and a drawstring slot provided in the lower member to accept the draw cable and the drawstring when an arrow is released; and e. an arrow rest to support and guide an arrow shot from said bow.

31. The overdraw apparatus of claim 30 wherein the draw cable slot and the drawstring slot are aligned generally parallel to the longitudinal axis and immediately forward of the drawstring and draw cable to a longitudinal depth in the lower member deeper than the forward travels of the drawstring and the draw cable when the bow is shot.

32. The overdraw apparatus of claim 30 wherein the arrow rest comprises a pair of rest members affixed on each side of the drawstring slot, such that the drawstring passes between the pair of arrow rest members when the bow is shot.

* * * * *